US009364090B2

(12) United States Patent
Fox

(10) Patent No.: US 9,364,090 B2
(45) Date of Patent: Jun. 14, 2016

(54) BRACKET FOR A PILASTER

(71) Applicant: FoxBlox, LLC, Lititz, PA (US)

(72) Inventor: Arlin Fox, Lititz, PA (US)

( * ) Notice: Subject to any disclaimer, the term of this patent is extended or adjusted under 35 U.S.C. 154(b) by 0 days.

(21) Appl. No.: 14/505,743

(22) Filed: Oct. 3, 2014

(65) Prior Publication Data

US 2015/0097474 A1 Apr. 9, 2015

Related U.S. Application Data

(60) Provisional application No. 61/886,727, filed on Oct. 4, 2014.

(51) Int. Cl.
*A47B 88/04* (2006.01)
*A47B 96/06* (2006.01)
*A47B 57/06* (2006.01)

(52) U.S. Cl.
CPC ..... *A47B 96/06* (2013.01); *A47B 57/06* (2013.01)

(58) Field of Classification Search
CPC ..... A47B 88/04; A47B 88/0407
USPC ..... 248/644, 657, 200.1, 218.4, 219.1, 248/219.2, 219.3
See application file for complete search history.

(56) References Cited

U.S. PATENT DOCUMENTS

| | | | | |
|---|---|---|---|---|
| 3,297,820 | A * | 1/1967 | Kew | H01B 17/145 174/163 F |
| 8,950,723 | B1 * | 2/2015 | Fogelstrom | A45B 11/00 135/16 |
| 9,145,697 | B1 * | 9/2015 | Avery, III | E04H 1/1266 |
| 2002/0104938 | A1 * | 8/2002 | Simard | A47B 57/34 248/218.4 |
| 2012/0292274 | A1 * | 11/2012 | Lin | A47B 88/044 211/86.01 |
| 2014/0217049 | A1 * | 8/2014 | Chen | E05D 15/08 211/195 |

* cited by examiner

*Primary Examiner* — Daniel Rohrhoff
(74) *Attorney, Agent, or Firm* — Steven O'Donell

(57) ABSTRACT

A bracket which attaches to a pilaster is disclosed. The bracket itself is useful for holding shelves in a cabinet. The bracket is most useful when more than two are combined in conjunction with a rail or similar track and used to support a drawer or movable shelf.

A dowel or peg on the bracket is inserted into a hole on a pilaster and the bracket rests against the pilaster, held in place by gravity and friction. A drawer rail or similar structure may connect two or more brackets so that a drawer or shelf is supported by the rail. The design of the brackets reduces the time and effort associated with placing such brackets and supports in cabinets and other structures.

4 Claims, 7 Drawing Sheets

BRACKET FOR A PILASTER

FIELD OF THE INVENTION

The subject matter of this application pertains to devices for reversibly attaching a drawer or shelf to a cabinet or similar structure. In particular, the subject matter of this application concerns an attachment means and a method of using this means to reversibly attach a bracket to a pilaster located inside of a cabinet. The brackets may be part of a track or similar structure upon which a drawer or shelf moves when opened or closed by a user. The pilaster and the bracket have design features that make accurate placement of the bracket easier than other such devices known in the art.

BACKGROUND

In order for a drawer to work as intended, there must be some sort of track system upon which the drawer slides within the cabinet when a user pulls or pushes the drawer.

Very generally, there are two basic designs of these systems. The first comprises ridges running along the sides of the drawer that rest upon complementary ridges located on the sides of the cabinet. The second style comprises rails that move against each other along typically wheeled tracks, thereby creating a smoother and steadier user experience.

The first style is often relegated to inexpensive, do-it-yourself, pre-fab furniture and bedroom bureaus. The first style usually does not comprise a stop to prevent the drawer from being pulled completely out of the cabinet, which may only be an annoyance if it results in the occasional spill of clothes, but can be quite dangerous if the drawer contains heavy and sharp kitchen tools. Further, since the first style requires the user to work against dry friction, the usefulness of the first style is diminished if the drawer contains a heavier load such as kitchen tools and flatware.

The second style is more commonly found in kitchen cabinets and other similar cabinets intended to house heavier loads since the wheels provide a smoother motion with greatly decreased friction over the first style, and because this style of track commonly also comprises some manner of stop that prevents a user from accidentally pulling the drawer out too far and causing a drawer of heavier and more dangerous items, e.g., knives and hammers to drop on the user's feet. Common variations of this style include one rail attached to each the cabinet wall and the side of the drawer, and two rails attached to the cabinet walls and clipped to the side or bottom of the drawer. The subject matter of this application can be used with any style of drawer attachment.

Neither of these styles are particularly easy to install, especially if one is trying to install the track to a cabinet that is already constructed and in place. It's fairly easy to attach the component of the system to the drawer itself since the drawer can be placed onto a workbench and the component placed so that it is parallel to the longitudinal axis of the drawer. It is much more difficult to place and attach the component attached to the cabinet itself. For the dry friction drawers, for example, there are two rails that need to be attached to the inside of the cabinet, and in order for the associated drawer to evenly rest on these rails, these rails need to be roughly parallel to the floor and substantially equidistant from the floor so that the weight of the drawer is distributed evenly across the rails. Therefore, for each rail attached to a cabinet wall, there must be at least two accurately placed points securing the rail to the cabinet. As both sides of a cabinet would require a rail, and each rail needs to be attached towards the front of the cabinet and towards the back of the cabinet so that the rails are secure and able to hold the drawer, an installer needs to accurately create at least four attachment points. In practice, to install a track of any design in a cabinet requires the installer to mark a first point of a track, and loosely attach the track to that point with a screw, then use a level to determine the placement of the second point of the track and reach to the back of the cabinet to drill a hole for the rear attachment screw and then screw the track into place. Once that side is attached, the installer needs to use a square or a level in conjunction with a straight-edge to mark the position of the track on the other side of the cabinet and drill and screw the second set of tracks into place. Assuming the four attachment points attaching the two rails to the inside of the cabinet are properly placed, then the drawer is ready to be placed within the cabinet. If the complementary tracks on the drawer do not properly align with the tracks installed on the cabinet one or more of the tracks will need to be removed, remeasured, and reattached so they do properly align.

Other designs may incorporate sliding rails or tracks that attach to the side or bottom of a drawer, but these other designs still need to be accurately placed within the cabinet and this placement is made easier by the subject matter of this application.

SUMMARY

The subject matter of this application relates to hardware used to support shelves and drawers or other similar surfaces. In particular, it relates to hardware supports often used by craftsmen to support drawers or shelves in cabinets as well as to support movable shelves. For ease of drafting, the terms 'drawer' or 'drawers,' unless otherwise specified, include not only the normal definition of a drawer, but also normally stationary shelves and shelves that can be pulled from a cabinet and pushed back into said cabinet. The subject matter of this application pertains to methods of securing these supports in which a bracket reversibly connects to a pilaster connected to, or formed into, a cabinet. The bracket may be part of a larger piece of hardware such as a drawer rail, or it may be used to position adjustable supports for shelves.

One objective of the subject matter of this application is to provide a support that securely locks into place, preventing or minimizing any lateral or forward movement of drawer rails. It is another objective of the subject matter of this application to provide a support that is stable, requiring both a rotational and a horizontal movement to disengage from its pilaster. Yet another objective of the subject matter of this application is provide a support capable a supporting heavier loads than similar support systems currently known in the relevant art. A further objective is to provide a drawer rail comprising two or more such supports systems, that can be quickly and accurately placed within a cabinet.

These objectives can be obtained by the supports disclosed here. The subject matter of this application comprises a bracket that is securely, but reversibly, connected to a pilaster. This pilaster comprises one of more holes that can accept a dowel pin which comprises part of the bracket. The bracket may also have a brace that presses against the side of the pilaster opposite to that comprising the dowel pin holes. In practice, the pilaster is either joined to the inside wall of a cabinet or similar structure or may be formed in situ by a skilled craftsman. The bracket is positioned so that its dowel pin can be inserted into the pilaster's hole. For embodiments comprising a brace, the bracket must be rotated away from the vertical surface of the inner cabinet to accommodate the bracket's brace. Once the dowel pin is fully inserted, the bracket is rotated so that the bracket's brace presses against the face of the pilaster. This design increases the stability of the bracket, and thereby the stability of whatever is attached to the bracket. One use for this support system is in attaching drawer rails to a cabinet. In that application, the drawer rails would comprise at least two brackets attaching it to the pilaster. When completely installed, drawers would then slide relative to the brackets when operated by the user. Another application of the support system is to support either movable or stationary shelves in a cabinet.

BRIEF DESCRIPTION OF THE ILLUSTRATIONS

Figure 1:
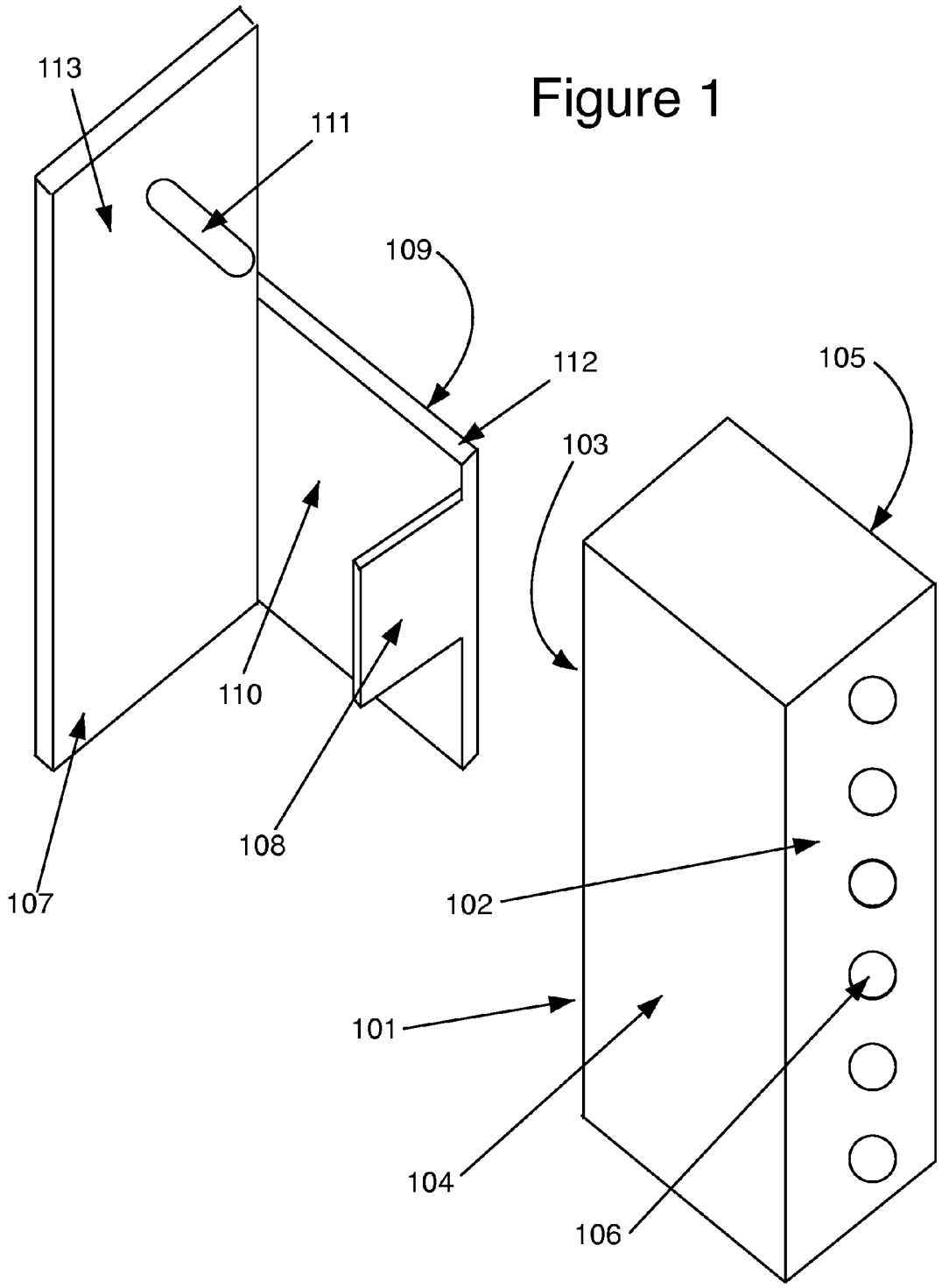
FIG. 1 illustrates the described bracket and pilaster. For clarity, the bracket is shown isolated from other hardware typically associated with the bracket such as a planar surface for the support of shelves, or a drawer rail.
Figure 2:
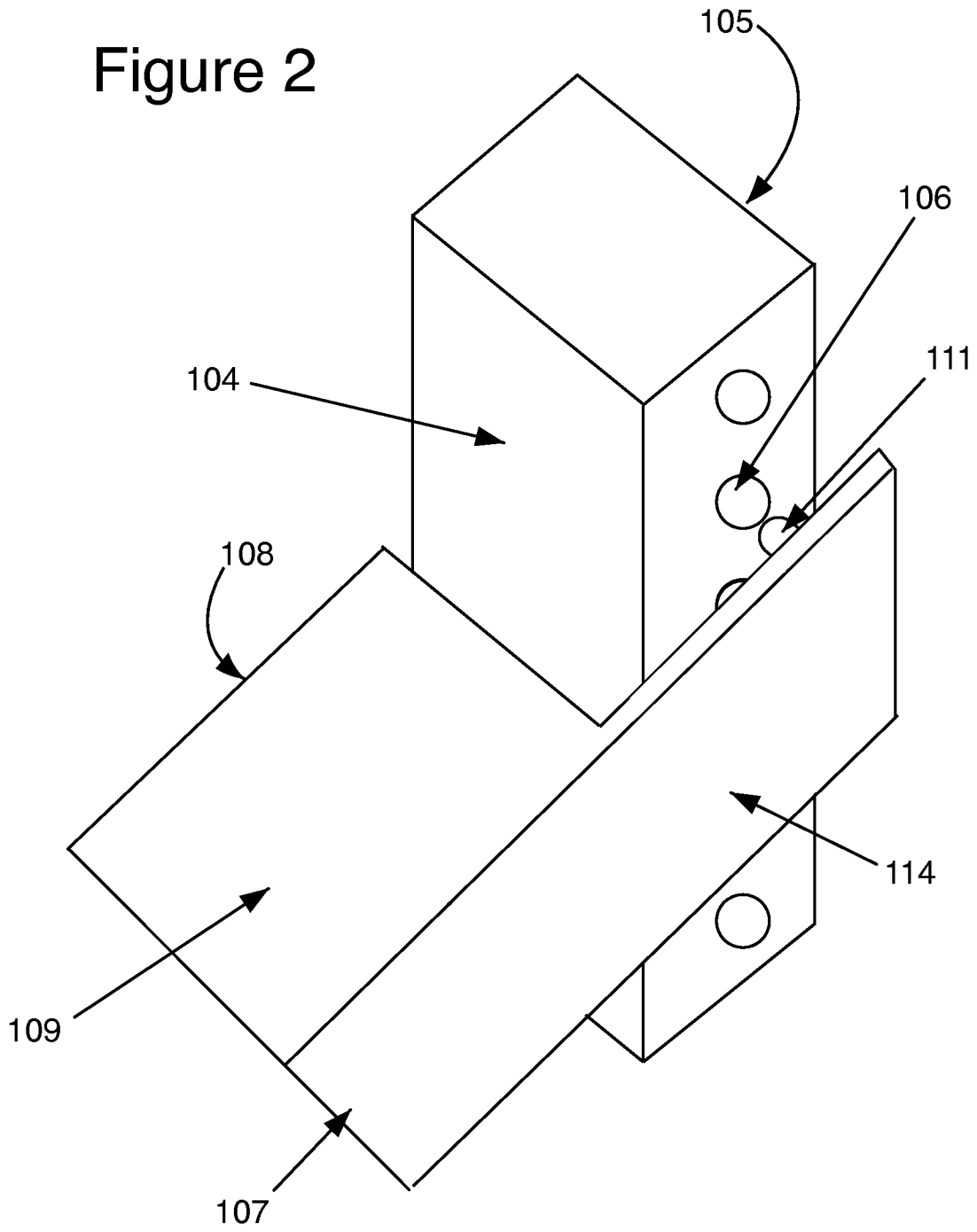
FIG. 2 illustrates how a bracket fits over and engages the pilaster.
Figure 3:
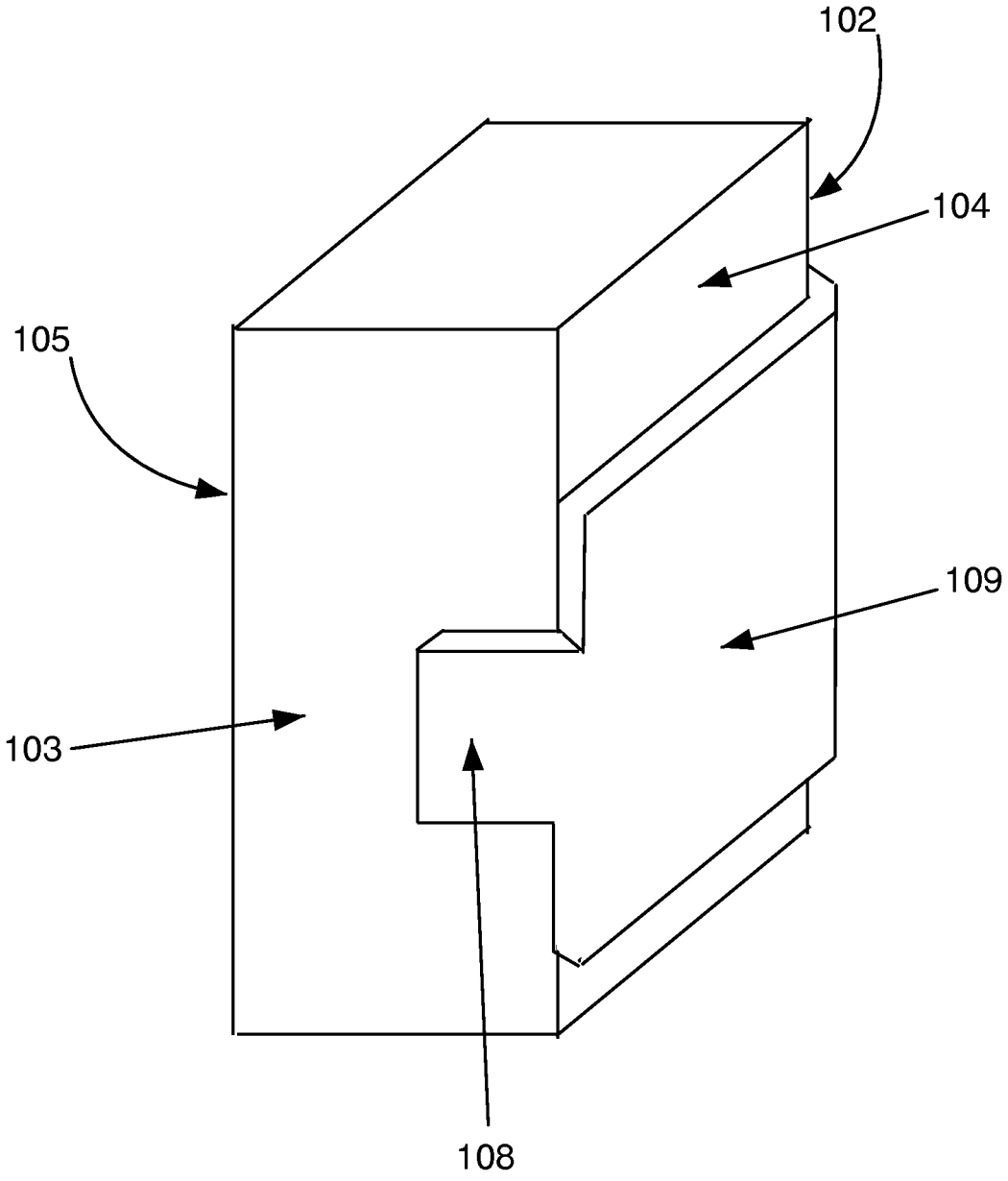
FIG. 3 illustrates a view of the bracket engaged with the pilaster and in it's final, stable, position.
Figure 4:
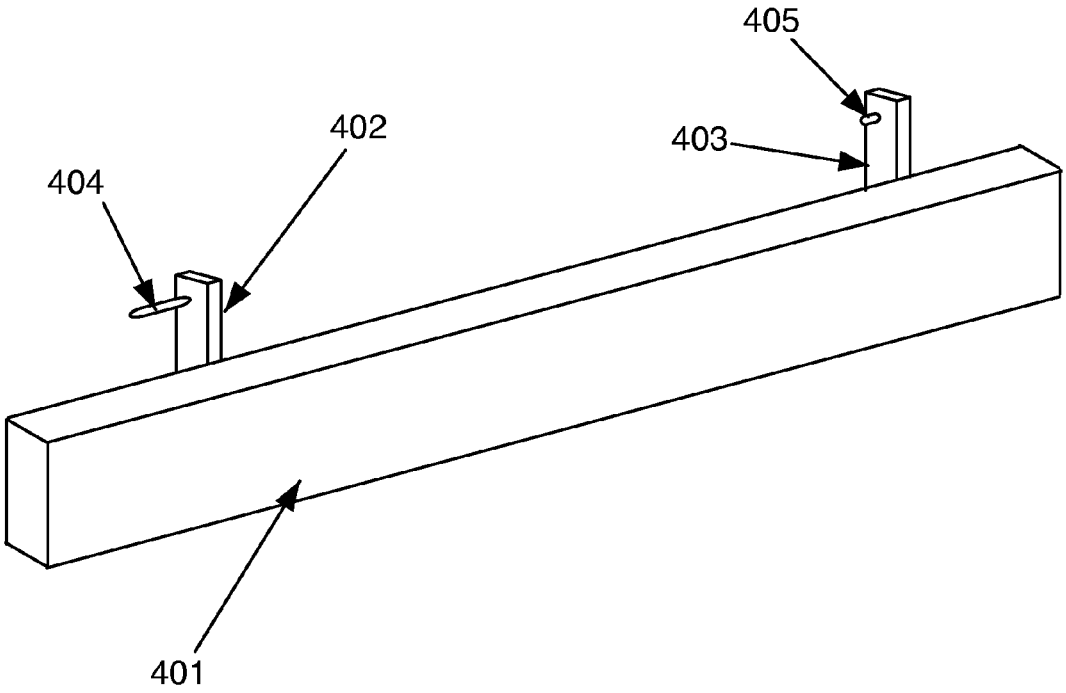
FIG. 4 illustrates a drawer rail comprising two of the described brackets.
Figure 5:
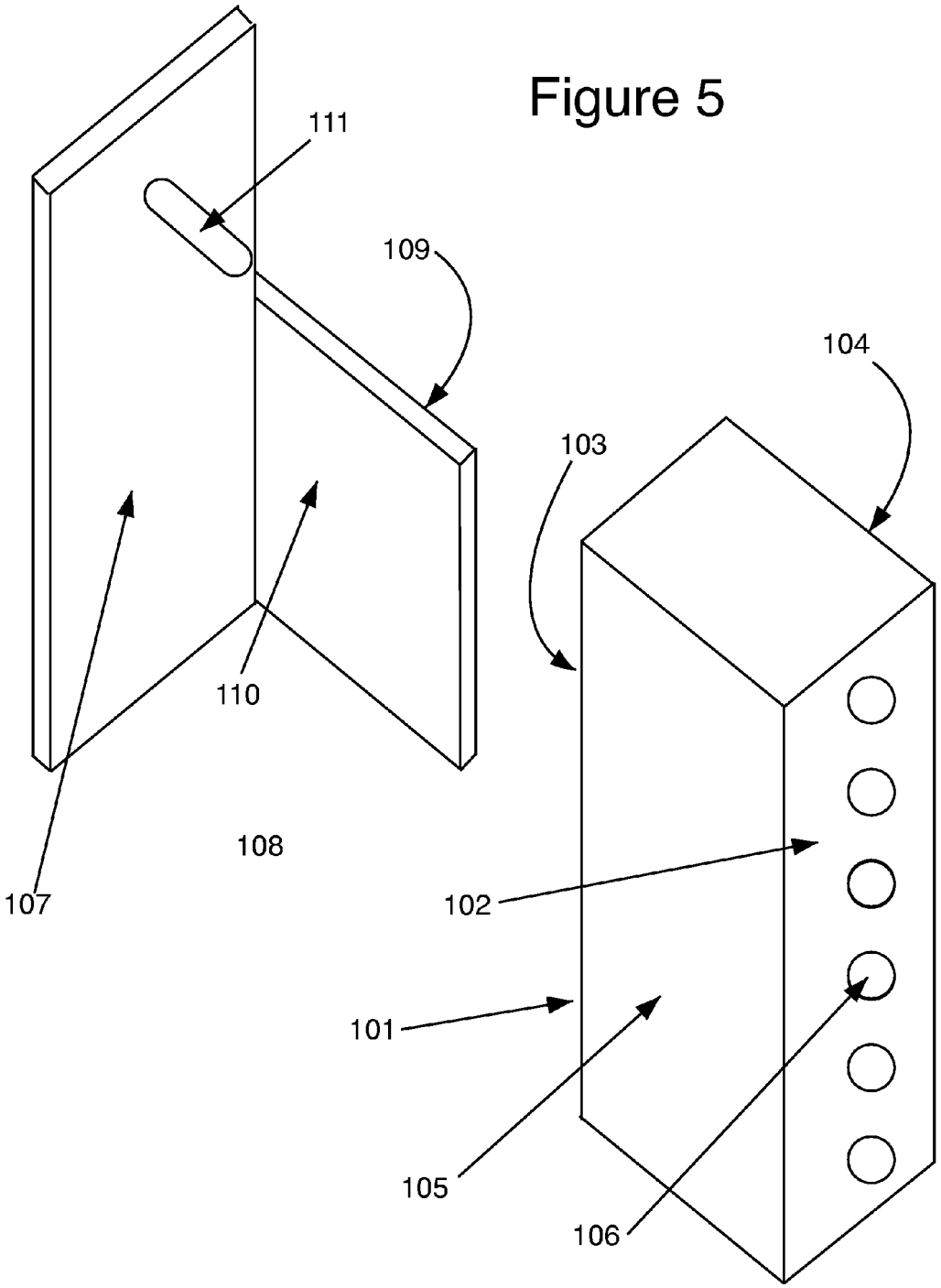

FIG. 5 illustrates the described bracket and pilaster. For clarity, the bracket is shown isolated from other hardware typically associated with the bracket such as a planar surface for the support of shelves, or a drawer rail. The bracket differs from that of FIG. 1 by the lack of a second projection (108). The pilaster in this figure has been rotated 180° from the view in FIG. 1 to show the pilaster's inner face.

Figure 6:
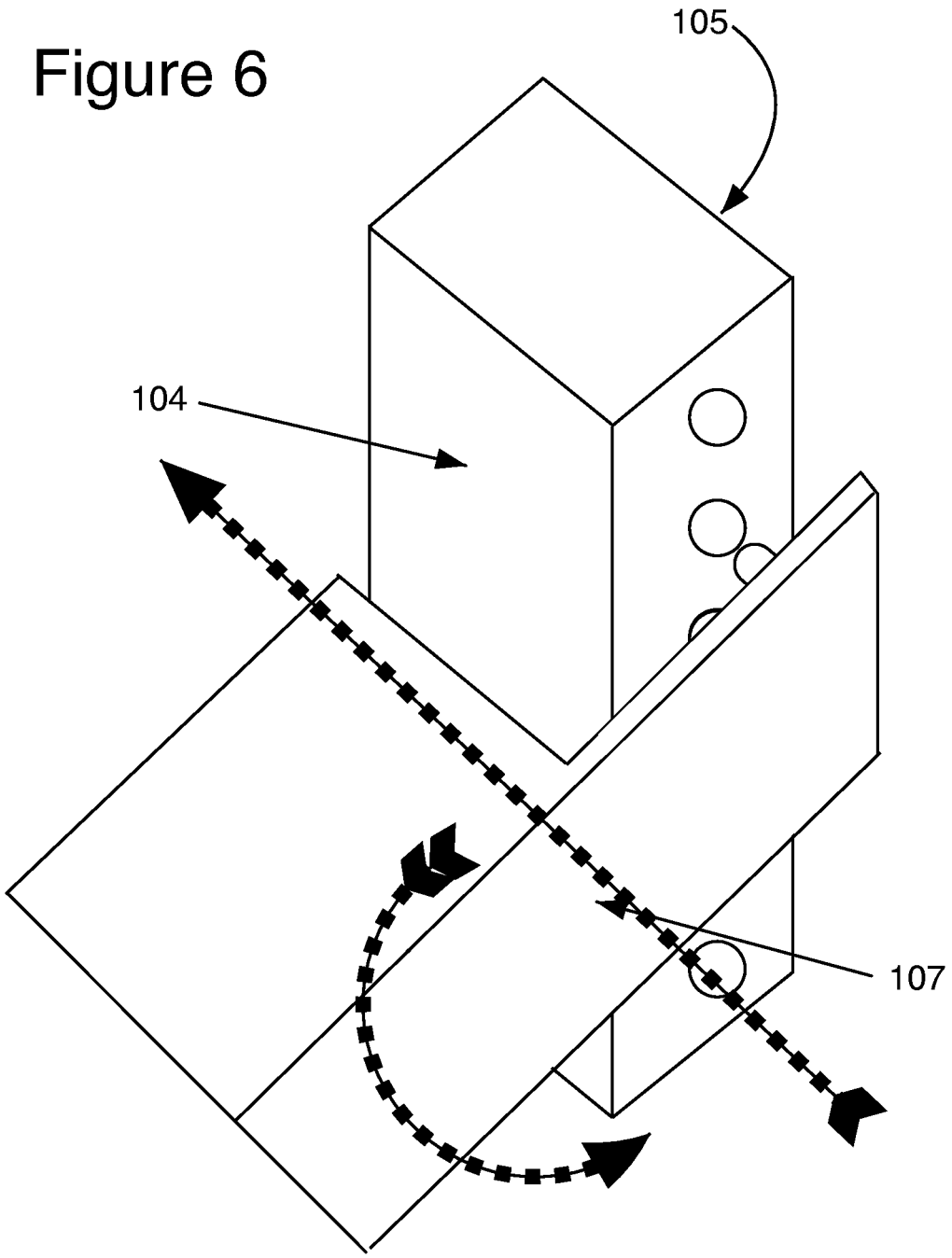

FIG. 6 illustrates how the bracket can be attached to the pilaster.

Figure 7:
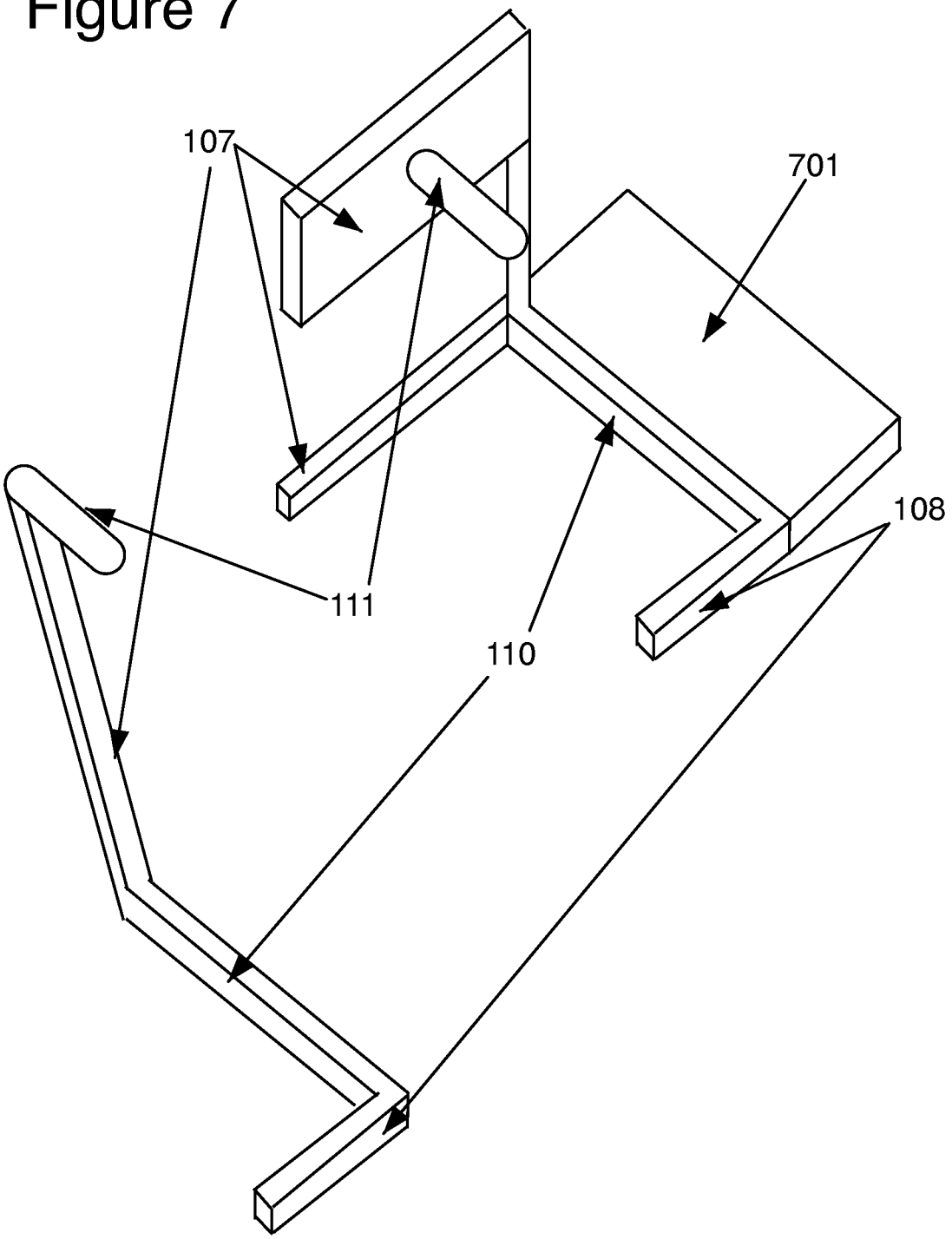

FIG. 7 illustrates two alternative embodiments of the disclosed bracket.

DETAILED DESCRIPTION OF THE ILLUSTRATION

The following description and drawings referenced therein illustrate embodiments of the application's subject matter. They are not intended to limit the scope. Those familiar with the art will recognize that other embodiments of the disclosed method are possible. All such alternative embodiments should be considered within the scope of the application's disclosure.

Each reference number consists of three digits. The first digit corresponds to the figure number in which that reference number is first shown. Reference numbers are not necessarily discussed in the order of their appearance in the figures.

In viewing the figures it is important to note that for most applications, the brackets and pilasters would be set in matched pairs mounted on opposite sides inside a cabinet or similar structure. Such matched sets would most likely utilize non-superimposable mirror image pairs. Unless otherwise indication, each figure illustrates a single bracket of such a matched pair. However, the illustration of a single bracket must be understood to also describe it's non-superimposable mirror image bracket.

The support comprises a pilaster (101) having a first face (102), a second face (103), an outer face (104), and an inner face (105). The pilaster can be formed into the cabinet, or more commonly, the inner face of the pilaster (105) is connected to the inside of a cabinet so that the inner face is against an inner side of the cabinet. One or more holes (106) are drilled into the pilaster's first face. In a preferred embodiment, the pilaster's first face is facing the front of the cabinet.

The bracket comprises a base (112) having an outer face (109), and an inner face (110), and further comprising a first projection (107), said first projections comprising an inner face (113) and outer face (114). The bracket may also comprise a second projection (108). The bracket's first projection's inner face comprises a dowel (111) having a length, a longitudinal axis, and a diameter equal to, or less than the depth of the pilaster's holes, so that the bracket's dowel can be inserted into a hole. If the bracket comprises a second projection, the distance between the bracket's first projection and second projection is at least as great as the distance between the pilaster's first face and second face such that the bracket's first and second projections surround the pilaster when engaged. As used, the term dowel should be understood to encompass all equivalent structures such as screws, tubes, and pegs.

As shown in the illustrations, the first projection (and, if present, the second projection) forms a right angle with the base portion. In practice, slightly more acute angles, or slightly more obtuse angles may also be useful. As used in this application, a substantially right angle is one between 80 and 100 degrees. Further, as it pertains to the dowel, substantially parallel means within 10 degrees of parallel.

To engage the bracket, a user manipulates it so that the bracket's dowel can be inserted into a hole on the pilaster and so that the bracket's second projection (if present) does not interfere with the placement. In a preferred embodiment, during insertion the bracket will need to be rotated 30 degrees or more from its final engaged position so that the dowel aligns with one of the pilaster's holes, although minor design changes may decrease or increase the required rotational displacement. After the dowel is inserted, the bracket is rotated down so that the bracket's base's inner face lies against the pilaster's outer face. The movement of the bracket in relation to the pilaster during the insertion of the dowel is indicated in FIG. 6 by the single feathered arrow. The double-feathered arrow of FIG. 6 indicates the rotational movement of the bracket following the insertion of the dowel to rest the bracket's base's inner face (110) against the pilaster's outer face (104).

The figures should not be read to limit the size or shape of the bracket's first or optional second projections. For example, the base, first, and second projections may comprise one or more "fingers" or strips of material having a width that may be as thin as several millimeters instead of the more planer design shown in FIGS. 1-6 in which the height of the first projection is the same as the height of the entire bracket. Two similar examples of the alternate "finger" design are shown in FIG. 7. Other modifications that replicate the functionality of the subject matter of this application may be evident to one in the art and should be considered within the scope of this application.

One useful embodiment is a support comprising a drawer rail (401), a first bracket (402) and a second bracket (403). The two brackets may be aligned and simultaneously engaged with corresponding pilasters as described. A most useful and preferred embodiment of the drawer rail comprises a first bracket and a second bracket in which one of the brackets comprises a longer dowel (404) than the other (405). With one dowel longer than the other, the longer dowel may be partially inserted into it's corresponding pilaster hole and thereby loosely held in place by that hole while the other, shorter dowel is moved to position just outside of it's corresponding pilaster's hole. Once the shorter dowel is in place, the rail is moved so that both dowels are fully inserted in their corresponding pilaster's hole, then the rail is rotated down so that both bracket's inner faces lies against its corresponding pilaster's outer face. In such a two-dowel-length embodiment, the shorter dowel's length is ideally no more than approximately 90% of the length of the longer dowel and no less than 50% of the length of the longer dowel, although any shorter dowel length that less than that of the longer dowel's length is useful.

A drawer rail (401) may comprise a track, a system of wheels, or any other structural features, but since these features or components are not claimed, a simple rectangular block is illustrated.

In many useful embodiments of the support, at least one of a support's said brackets comprises a second projection (108). This second projection prevents the bracket, and thereby, the drawer rail from being displaced when the drawer is pulled or pushed.

In yet another embodiment, the bracket further comprises a planar support (701) for shelves or similar objects that is perpendicular to the pilaster when the bracket is engaged. Such a support is shown in one of the alternate designs of FIG. 7.

The invention claimed is:

1. A bracket comprising a longitudinal axis and a transverse axis, a base portion, a first projection, a second projection, a top and a bottom, a. said base portion having a width transverse to the bracket's longitudinal axis, a length parallel to the bracket's longitudinal axis, an internal face and an external face, b. said first projection having a width transverse to the bracket's longitudinal axis, a length parallel to the bracket's longitudinal axis, an internal face and an external face, c. said base portion and first projection being connected to each other and forming a substantially right angle such that the bracket can be placed against a rectangle parallel to the bracket's longitudinal axis so that the base portion's internal face and the first projection's internal face are largely in continuous contact with said rectangle, d. said first projection further comprising a dowel having a length and a diameter, i. said dowel having an orientation substantially parallel to the bracket's transverse axis, and ii. having a point of origin on the said first projection's internal face, a) said point of origin located at a level along the first projection's length greater than the said base portion's length, e. said second projection having a width transverse to the bracket's longitudinal axis, a length parallel to the bracket's longitudinal axis, an internal face and an external face, f. said base portion and second projection being connected to each other and forming a substantially right angle such the said first projection's internal face is largely parallel to, and faces, the second projection's internal face.

2. A drawer support system comprising a first component, a front bracket, and a back bracket, wherein each of the said brackets comprises a longitudinal axis and a transverse axis, a base portion, a first projection, and, a top and a bottom, a. said base portion of each of the said brackets having a width transverse to the bracket's longitudinal axis, a length parallel to the bracket's longitudinal axis, an internal face and an external face, b. said first projection of each of the said brackets having a width transverse to the bracket's longitudinal axis, a length parallel to the bracket's longitudinal axis, an internal face and an external face, c. said base portion and said first projection of each said bracket being connected to each other and forming a substantially right angle such that the bracket can be placed against a rectangle parallel to the bracket's longitudinal axis so that the first projection's internal face and the base portion's internal face are largely in continuous contact with said rectangle, d. each said bracket's said first projection further comprising a dowel having a length and a diameter, i. said dowel having an orientation substantially parallel to the bracket's transverse axis, and ii. having a point of origin on the said first projection's internal face, a) said point of origin located at a level along the first projection's length greater than the said base portion's length, e. said first component connecting said front bracket and said back bracket, f. at least one of the brackets further comprising a second projection, i. said second projection being substantially planar and having a width transverse to the bracket's longitudinal axis, a length parallel to the bracket's longitudinal axis, an internal face and an external face, ii. said base portion and second projection being connected to each other and forming a substantially right angle such the said first projection's internal face is largely parallel to, and faces, the second projection's internal face.

3. The drawer support device of claim 2, wherein one of the said brackets' said dowels has a length less than that of the other bracket's said dowel's length.

4. The drawer support device of claim 2, wherein one of the said brackets' said dowels has a length between 50 and 90% of the other bracket's said dowel's length.

* * * * *